US005326008A

United States Patent [19]

Polak et al.

[11] Patent Number: 5,326,008

[45] Date of Patent: Jul. 5, 1994

[54] BREAKER TOOL FOR ADJUSTING THE SIZE OF HANGING FILE FRAMES TO FIT INTO A DESIRED DRAWER OF A DESK OR CABINET

[75] Inventors: Donald J. Polak, Brentwood; Kenneth E. McDonald, Columbia, both of Tenn.

[73] Assignee: Pelikan, Inc., Franklin, Tenn.

[21] Appl. No.: 48,827

[22] Filed: Apr. 13, 1993

Related U.S. Application Data

[62] Division of Ser. No. 865,370, Apr. 8, 1992, Pat. No. 5,237,732.

[51] Int. Cl.[5] ..... B26F 3/02

[52] U.S. Cl. ..... 225/93

[58] Field of Search ..... 81/121.1, 119; 225/93

[56] References Cited

U.S. PATENT DOCUMENTS

| | | | |
|---|---|---|---|
| D. 130,756 | 12/1941 | Howard | 81/119 X |
| 264,696 | 9/1882 | Hillard | 225/93 |
| 717,735 | 1/1903 | Coffin | 225/93 |
| 1,173,026 | 2/1916 | Petermann | 81/119 X |
| 2,534,756 | 12/1950 | Corrado | 225/93 |
| 2,711,109 | 6/1955 | Gillstrom | 225/93 |
| 4,195,760 | 4/1980 | Bos | 225/93 X |

*Primary Examiner*—Timothy V. Eley

*Attorney, Agent, or Firm*—John F. A. Earley; John F. A. Earley, III

[57] ABSTRACT

A hand-held breaker tool for adjusting the length of the side rails of frames that support hanging file folders in a drawer. The tool is used to break off an unwanted excess length portion of the side rails. A method of adjusting and assembling a frame for holding and supporting hanging file folders and inserting the frame into a drawer of a desk or file cabinet.

2 Claims, 4 Drawing Sheets

BREAKER TOOL FOR ADJUSTING THE SIZE OF HANGING FILE FRAMES TO FIT INTO A DESIRED DRAWER OF A DESK OR CABINET

This is a divisional of copending application(s) Ser. No. 07,865,370 filed on Apr. 3, 1992, and now U.S. Pat. No. 5,237,732.

BACKGROUND OF THE INVENTION

1. Field of the Invention

The present invention relates to a hand-held breaker tool for adjusting the length of a frame for supporting hanging file folders to fit in a drawer of a desk or cabinet, a method of adjusting the length of the frame to fit into the drawer, and a method of adjusting the length of and assembling the frame for holding hanging file folders in the drawer.

2. Description of the Prior Art

Hanging file folders for drawers of desks or cabinets are in common use today and the file folders comprise two reinforced top edge members with hooks extending outwardly therefrom which hook over side rails of a hanging folder frame support, and a web extending between the top edge members which holds papers in the file folder. The hanging folders stay upright instead of sagging below the top portions of a horizontal stack of files and disappearing from sight like with conventional file folders. The hooks extending from the reinforced top edge members of the hanging file folders hold the folder in position on a hanging file support frame, and also slide easily along side rails of the hanging file support frame so that the hanging file folders may be easily pushed back and forth to insert a file folder into the drawer or withdraw a file folder from the drawer. An example of a hanging file support frame is shown in U.S. Pat. No. 4,526,277 which issued on Jul. 2, 1985, and in Canadian Patent No. 1,198,764 which issued Dec. 31, 1985. Both patents issued to Corvent International Limited, and both patents are incorporated herein by reference.

It is conventional today to provide hanging file support frames as a kit in knock-down condition with side rails of a standard size which may be too long for insertion into the customer's desk drawer or filing cabinet draw. It is also conventional to provide the side rails with a series of crimps or score lines which are lines of weakness, so that the customer can and adjust the length of the side rails to fit a drawer by breaking-off an unwanted end portion of the side rail at a crimp line of weakness.

However, one of the problems encountered by a customer trying to put the support frame together is that he must find a way to break the side support rails at the proper length. This is not always easy to do, especially if the customer does not have any tools. Even if the customer does have an assortment of tools available, it is sometimes difficult to break the rail at the desired crimp line. In some cases, a customer has resorted to sawing the rail at the crimp line, which is difficult.

SUMMARY OF THE INVENTION

To overcome the problems involved in tailoring and adjusting the length of the frame and its side support rails, this invention contemplates supplying the end user with a breaker tool to assist in "breaking", or flexing until fatigued, the side rails at the proper length. The breaker tool comprises a handle portion and a head portion having a transverse slot. In the method of using the breaker tool, the end user puts the unwanted portion of the side support rail into the transverse slot to a desired score line, and then flexes the unwanted end portion of the side rail back and forth with the tool until the rail breaks at the crimp line.

DETAILED DESCRIPTION OF THE DRAWINGS

Figure 1:
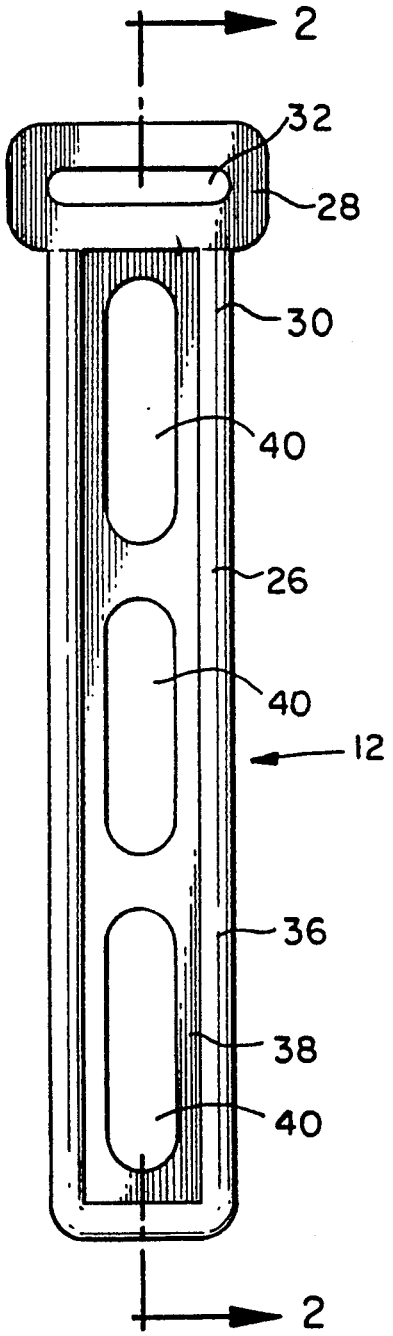
FIG. 1 is a view in front elevation of a breaker tool constructed in accordance with this invention.

Turning now to the drawings, there is shown a hand-held breaker tool 12 for adjusting the length of the side rails 14 of frames 16 that support hanging file folders 18 in a drawer 20 by breaking off an unwanted excess length portion 22 of the side rails 14.

The side rails 14 are provided with a series of spaced-apart vertical crimp lines 24 of weakness along end portion 22 of the side rail 14.

Breaker tool 12 has a longitudinal handle portion 26, and a head portion 28 integral with handle portion 26 and positioned at one end 30 of the handle portion 26. A transverse slot 32 is formed in the head portion 28.

When a side rail 14 of a frame 16 for supporting hanging file folders 18 is inserted into the transverse slot 32 adjacent a crimp line 24, and the unwanted excess end portion 22 of the side rail 14 is subjected to bending back and forth about the crimp line 24, the side rail 14 breaks off at the crimp line 24 to adjust the length of the remaining side rail 14 to the proper size to fit into a desired drawer of a desk or of a file cabinet.

The method of adjusting the length of a side rail 14 of a frame 16 that supports hanging file folders 18, with the side rail 14 having a series of spaced-apart vertical crimp lines 24 of weakness spaced along an end portion 22 of the side rail 14, comprises providing a hand-held breaker tool 12 which has a longitudinal handle portion 26, a head portion 28 integral with the handle portion 26 positioned at one end of the handle portion 26, and a transverse slot 32 formed in the head portion 28. The unwanted end portion 22 of the side rail 14 is inserted into the transverse slot 32 of the breaker tool 12 until the slot 32 is adjacent to the vertical crimp line 24 that is to form the desired end of the rail 14. The wanted portion 34 of the side rail 14 is held still, and the breaker tool 12 is manipulated to bend the unwanted end portion 22 of the rail 14 back and forth about the crimp line 24 until the rail 14 breaks at the crimp line 24. The unwanted portion 22 of the rail 14 is discarded, and the wanted portion 34 of the rail 14 is used in assembling the frame 16 which is inserted into the drawer 20 to hold the hanging file folders 18.

Figure 4:
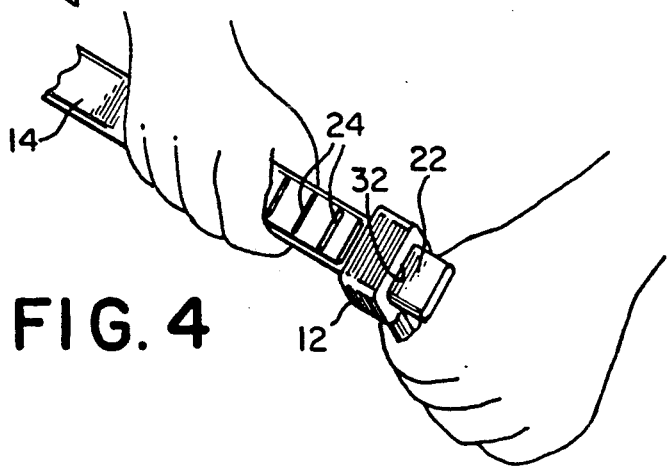
FIG. 4 is a view in perspective showing a breaker tool in break position with a portion of a side rail of a hanging folder frame inserted therein.

FIG. 4 illustrates the method whereby the wanted portion 34 of the rail 14 is held in the hand of the user in a fixed position, and the bending of the unwanted excess length portion 22 is accomplished by manipulating the breaker tool 12 to bend the unwanted excess length portion 22 back and forth about the crimp line adjacent to it.

Figure 2:
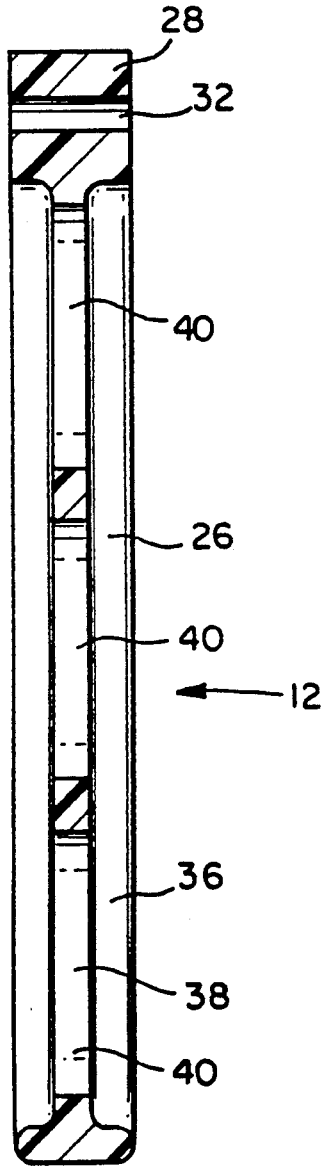
FIG. 2 is a view in vertical section of the breaker tool taken as indicated by the lines and arrows 2—2 which appear in FIG. 1.
Figure 5:
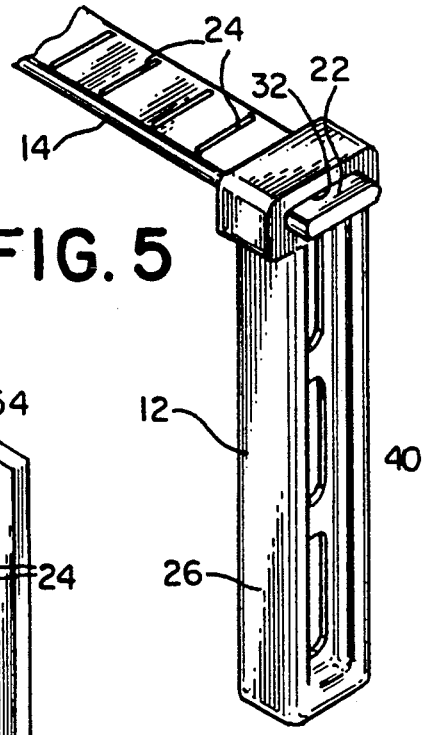
FIG. 5 is another view showing the breaker tool with a portion of a side rail inserted therein.
Figure 3:
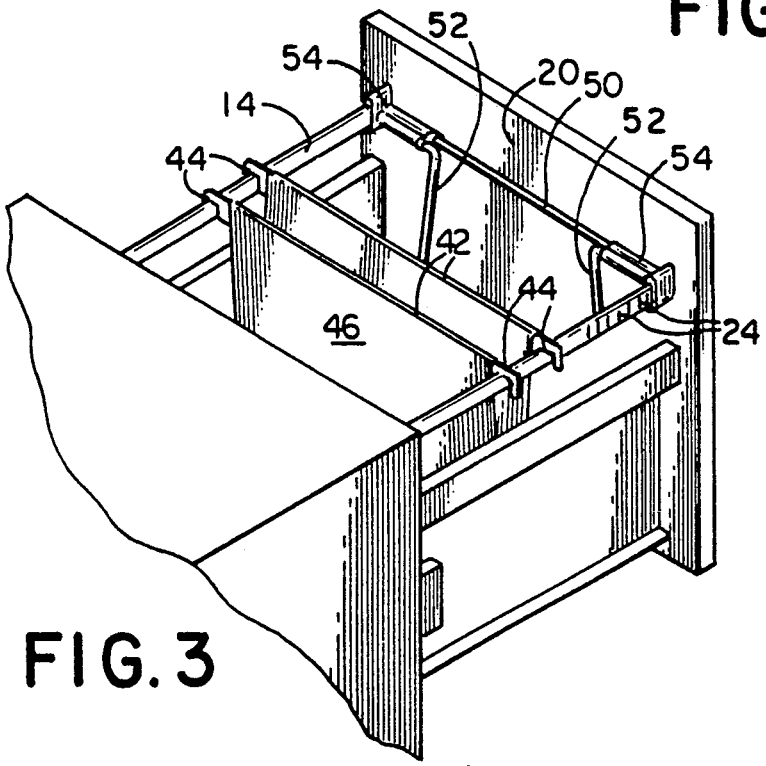
FIG. 3 is a view in perspective illustrating a hanging file frame supporting a hanging file folder in a desk drawer.

FIGS. 1 and 2 show the breaker tool 12 in greater detail. Handle portion 26 has a thicker border portion 36 that surrounds a thinner central portion 38 which has three longitudinal openings 40. FIG. 2 also illustrates the depth of transverse slot 32.

Figure 6:
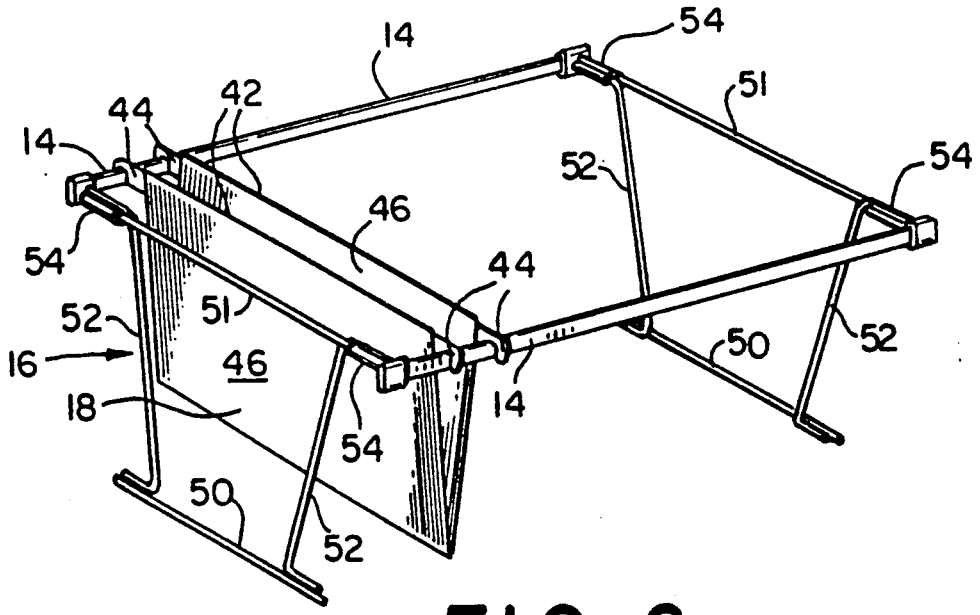
FIG. 6 is a view in perspective of a hanging file frame showing a hanging file folder supported on the frame.

FIG. 6 shows the frame 16 in assembled condition with a hanging file folder 18 supported by the side rails 14. Hanging files 18 have a pair of reinforced upper support edge members 42 with hooks 44 extending from each side of edge members 42, and a web 46 extending from one edge member to the other. The hooks 44 are supported by the side rails 14 and the hooks are easily slidable along the side rails 44 to hold the file folders 18 upright so that you can see the top of the file folders 18 and any identification that appears thereon.

FIGS. 7 through 11 illustrate the steps in the assembly operation of the frame 16 after the rails 14 have been broken off to proper length.

Figure 7:
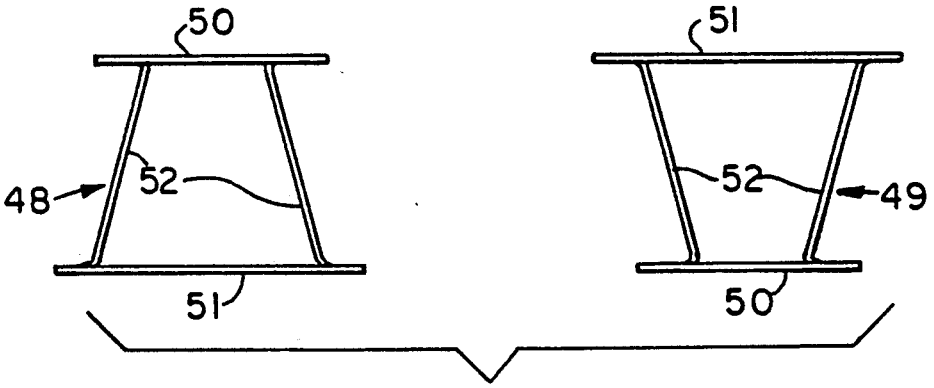
FIG. 7 is a view in elevation of individual end frame support members, with the left hand end frame support member having its shorter end frame horizontal member on top to accommodate letter-size hanging folders, and with the right hand end frame support member with its longer horizontal member on top to accommodate legal-size hanging folders.

FIG. 7 shows an elevation view of two end frame members 48,49 of the frame 16 with end frame member 48 having its shorter horizontal member 50 up and end frame member 49 having its longer horizontal member 51 up. Horizontal members 50 are connected to horizontal members 51 by a pair of vertical side wires 52. You select letter or legal size by simply reversing the position of the horizontal members.

Figure 8:
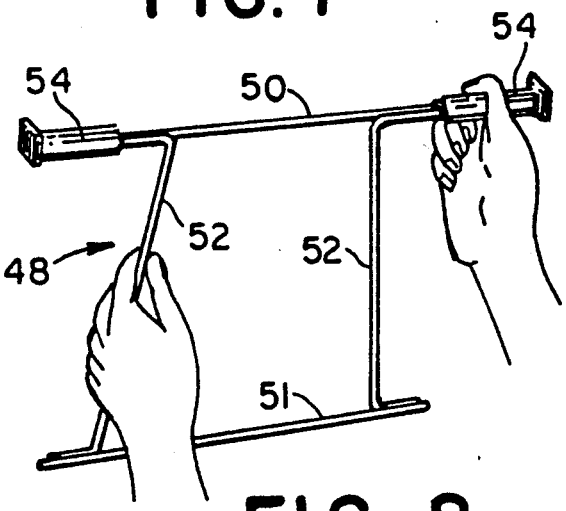
FIG. 8 shows a view in elevation of an end frame support member and illustrates the step of attaching plastic corner posts to the ends of the top horizontal member.

FIG. 8 shows putting one plastic corner post 54 on each end of the upper horizontal member 51, with slot 56 in plastic corner post 54 being positioned so that it faces you as you are assembling the frame 16.

Figure 9:
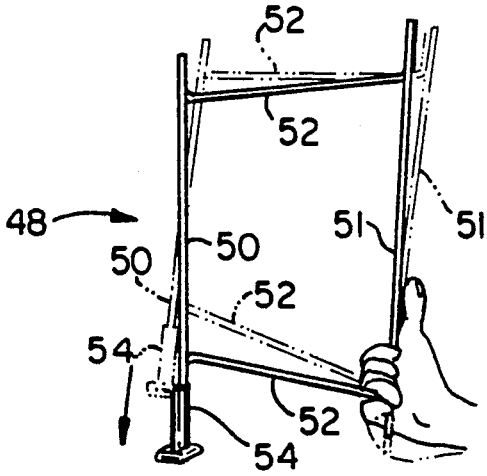
FIG. 9 shows the next step which comprises tapping each of the plastic corner posts on the floor to ensure that they are on the top horizontal member as far as they will go.

FIG. 9 illustrates the step of gently tapping each of the four corner posts 54 on the floor to insure that they are on the horizontal member 51 as far as they go.

Figure 10:
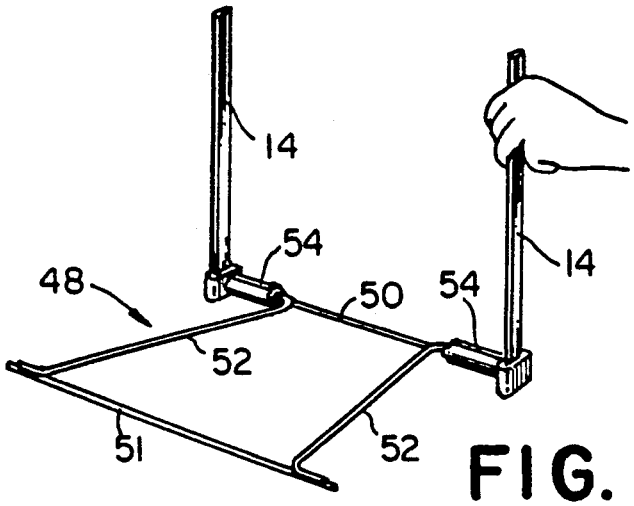
FIG. 10 illustrates the next step in the method of assembly comprising pushing each of two side rails into the plastic corner posts of one of the end frame support members.

FIG. 10 illustrates the step of placing one of the end frame members 48 on a flat surface and pushing each of the two side rails 14 into the slots 56 in its plastic corner posts 54 as far as they go.

Figure 11:
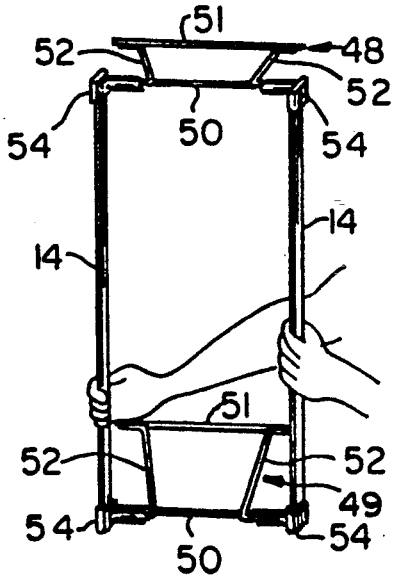
FIG. 11 shows the next step in the method of assembly of the hanging file frame which comprises placing the other end section on a flat surface and pushing the opposite ends of the side rails into the corner posts.

FIG. 11 shows the step of placing the other end frame member 49 on a flat surface and pushing the opposite end of the side rails 14 into the slots 56 in the corner posts 54.

And that's all there is to it, the frame 16 is assembled and ready to be inserted into a drawer and support hanging file folders 18.

ADVANTAGES

The frame 16 of the present invention and its breaker tool 12 have the advantage of eliminating the need for using a vise or pliers to break off the unwanted portion 22 of side rails 14. The customer uses just the breaker tool 12 to assemble the frame 16, and does not have to look around for a pair of pliers to break rails 14, or for a saw to saw off the unwanted end portion 22. This solves a problem for customers who buy the frame kit and do not have a tool to break off the unwanted portion 22 of rails 14 to fit the file frame into their desk drawer.

We claim:

1. A hand-held breaker tool for adjusting the length of side rails of frames that support hanging file folders in a drawer, by breaking off an unwanted excess length portion of the side rails, said side rails extending in a longitudinal direction and having a series of spaced apart crimp lines of weakness along an end portion of the side rails extending perpendicular to the longitudinal direction, comprising a tool having a longitudinal handle portion extending in a first direction, a head portion integral with the handle portion and positioned at one end of the handle portion and in line with the handle portion, and a transverse slot formed in the head portion and extending in a second direction which is perpendicular to the first direction and adapted, whereby when a side rail of a frame for supporting hanging files is inserted in the second direction into said transverse slot adjacent a crimp line of weakness, and the unwanted excess end portion of the side wall rail is subjected to bending back and forth about the crimp line, the side rail breaks off evenly only along the crimp line to adjust the length of the side rail to the proper size to fit into a desired drawer.

2. The hand-held breaker tool of claim 1, the handle portion having a border portion along its periphery and a central portion surrounded by the border portion, the border portion having a thickness in the second direction which is greater than a thickness of the central portion in the second direction.

* * * * *